US008760379B2

(12) United States Patent
Choi

(10) Patent No.: US 8,760,379 B2
(45) Date of Patent: Jun. 24, 2014

(54) DRIVING CIRCUIT FOR DISPLAY PANEL HAVING USER SELECTABLE VIEWING ANGLE, DISPLAY HAVING THE SAME, AND METHOD FOR DRIVING THE DISPLAY

(75) Inventor: Dong Wan Choi, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1537 days.

(21) Appl. No.: 11/932,145

(22) Filed: Oct. 31, 2007

(65) Prior Publication Data

US 2008/0198118 A1 Aug. 21, 2008

(30) Foreign Application Priority Data

Feb. 20, 2007 (KR) ..... 10-2007-0017076

(51) Int. Cl.
*G09G 3/36* (2006.01)

(52) U.S. Cl.
USPC ..... 345/89; 345/87; 345/100; 345/204; 345/690

(58) Field of Classification Search
USPC ..... 345/89, 100, 204, 690
See application file for complete search history.

(56) References Cited

U.S. PATENT DOCUMENTS 4,120,567 A * 10/1978 Goodman et al. ..... 349/177
5,489,917 A * 2/1996 Ikezaki et al. ..... 345/89
5,659,331 A * 8/1997 Oh et al. ..... 345/95
6,236,384 B1 5/2001 Didier et al.
6,633,271 B1 * 10/2003 Motegi et al. ..... 345/87
6,750,839 B1 * 6/2004 Hogan ..... 345/98
7,023,458 B2 * 4/2006 Kudo et al. ..... 345/690
7,123,223 B2 * 10/2006 Moon ..... 345/89
7,193,637 B2 3/2007 Kudo et al.
7,511,693 B2 3/2009 Kudo et al.
7,595,776 B2 9/2009 Hashimoto et al.
7,639,224 B2 * 12/2009 Moon ..... 345/87
8,120,561 B2 2/2012 Kudo et al.
2002/0186230 A1 12/2002 Kudo et al.
2005/0168416 A1 8/2005 Hashimoto et al.

(Continued)

FOREIGN PATENT DOCUMENTS

JP 10319373 12/1998
JP 11338436 12/1999

(Continued)

OTHER PUBLICATIONS

English Abstract for Publication No. 10-2005-0078243.

(Continued)

*Primary Examiner* — Grant Sitta
(74) *Attorney, Agent, or Firm* — F. Chau & Associates, LLC

(57) ABSTRACT

A driving circuit for a display panel comprising a driving voltage generator for outputting a plurality of gamma reference voltages, and a gray scale voltage generating unit for selecting one out of the plurality of gamma reference voltages and generating a gray scale voltage based on the selected gamma reference voltage, a liquid crystal display having the driving circuit, and a method for driving the liquid crystal display. A gamma reference voltage is dynamically changed depending on a user's selection, so that a gray scale voltage is changed, thereby varying the gamma characteristic and the viewing angle of an output image. Accordingly, a user can actively control the gamma characteristic and the viewing angle of an output image to be suitable for a user's preference and environment.

22 Claims, 5 Drawing Sheets

(56) References Cited

U.S. PATENT DOCUMENTS

| | | | | |
|---|---|---|---|---|
| 2005/0200584 | A1 | 9/2005 | Kudo et al. | |
| 2006/0036695 | A1 | 2/2006 | Rolnik | |
| 2006/0055828 | A1* | 3/2006 | Henry et al. | 348/674 |
| 2006/0109224 | A1 | 5/2006 | Chang et al. | |
| 2007/0001939 | A1 | 1/2007 | Hashimoto et al. | |
| 2007/0024560 | A1* | 2/2007 | Kim et al. | 345/94 |
| 2008/0111781 | A1* | 5/2008 | Bae | 345/89 |
| 2009/0184985 | A1 | 7/2009 | Kudo et al. | |
| 2012/0139972 | A1 | 6/2012 | Kudo et al. | |

FOREIGN PATENT DOCUMENTS

| | | |
|---|---|---|
| JP | 2003122310 | 4/2003 |
| JP | 2003295160 | 10/2003 |
| JP | 2005148190 | 6/2005 |
| JP | 2006208575 | 8/2006 |
| JP | 2006276363 | 10/2006 |
| KR | 1999-0074686 | 10/1999 |
| KR | 1020030005801 | 1/2003 |
| KR | 1020030029733 | 4/2003 |
| KR | 1020040011940 | 2/2004 |
| KR | 10-2005-0078243 | 8/2005 |
| KR | 10-2006-0014253 | 2/2006 |
| KR | 1020060032035 | 4/2006 |
| KR | 10-2006-0055502 | 5/2006 |

OTHER PUBLICATIONS

English Abstract for Publication No. 10-2006-0055502.
Korean Office Action Dated June 13, 2013.
Korean Office Action Dated November 26, 2013.

* cited by examiner

FIG. 4

| Gamma selection signal(SEL) | Gamma reference voltage(GVDD) |
|---|---|
| 0 0 | 4.5V |
| 0 1 | 4.0V |
| 1 0 | 3.5V |
| 1 1 | 3.0V |

DRIVING CIRCUIT FOR DISPLAY PANEL HAVING USER SELECTABLE VIEWING ANGLE, DISPLAY HAVING THE SAME, AND METHOD FOR DRIVING THE DISPLAY

This application claims priority, under 35 U.S.C. 119, of Korean Patent application No. 10-2007-0017076, filed on Feb. 20, 2007 which is incorporated herein by reference in its entirety.

BACKGROUND OF THE INVENTION

1. Field of the Invention

The present invention relates to liquid crystal displays, and more particularly, to a driving circuit for a display panel capable of actively controlling a gamma characteristic and the viewing angle of an output image according to a user's preference and/or environment, a liquid crystal display having the driving circuit and a method for driving the liquid crystal display.

2. Description of the Related Art

A typical liquid crystal display (LCD) includes an LCD panel, having an upper substrate with color filters and a common electrode formed thereon, and a lower substrate with thin film transistors and pixel electrodes formed thereon, and a liquid crystal layer interposed between both the substrates, and a backlight as a light source positioned behind the LCD panel. Further, a polarizer may be attached to a surface of the LCD panel to control the transmissivity of light from the backlight exiting the liquid crystal layer.

An image displayed on such a conventional LCD has predetermined fixed gamma and viewing angle characteristics, which depends upon a gray scale voltage (or gamma voltage) that is referenced to a data signal applied to a pixel electrode.

However, since a reference voltage when generating a gray scale voltage, i.e., a gamma reference voltage GVDD, is fixed at one state (standard state) in a conventional LCD, it is difficult to change the gamma characteristic and the viewing angle of an output image depending on a user's preference and environment. For example, since a characteristic of a favorite image is different depending on a user, the gamma characteristic of an output image is required to be controlled considering a user's preference. Further, in a conventional LCD, a wide viewing angle is typically required to display better an image in terms of enhanced visibility. However, for the protection of a user's privacy in public places, a narrow viewing angle is also required so as not to display an image to others. Therefore, the viewing angle of an output image needs to be adjusted considering a user's preference and environment.

SUMMARY OF THE INVENTION

An aspect of the present invention provides a driving circuit for a display panel capable of dynamically changing the gamma characteristic and the viewing angle of an output image according to a user's preference and environment by enabling the user to change the gamma reference voltage; a liquid crystal display having the driving circuit for a display panel; and a method for driving the liquid crystal display.

According to an aspect of the present invention, there is provided a driving circuit for a display panel, including: a driving voltage generator configured to output a plurality of reference voltages; and a gray scale voltage generating unit configured to select one among the plurality of reference voltages as the gamma reference voltages and generating at least one (e.g., a plurality of) gray scale voltages based on the selected gamma reference voltage.

The gray scale voltage generating unit may include a voltage selector configured to select (and output) one among the plurality of gamma reference voltages; a voltage distributor configured to generate a plurality of distribution voltages using the selected gamma reference voltage; a multiplexer unit configured to select some of the plurality of distribution voltages and to output the selected distribution voltages as gray scale selection voltages; and a gray scale voltage output unit for generating a plurality of gray scale voltages using the gray scale selection voltages and outputting the plurality of gray scale voltages.

The voltage selector may include at least one multiplexer.

The multiplexer may select and output one out of the plurality of reference voltages as the gamma reference voltage according to an external control signal.

The driving circuit may further include a driving voltage generator for generating the plurality of reference voltages having different voltage levels.

The driving voltage generator may include a plurality of DC-to-DC converters.

The voltage distributor may include a first input terminal to which a highest potential voltage is applied; a second input terminal to which a lowest potential voltage is applied; and an upper variable resistor unit, a voltage distribution (divider) unit and a lower variable resistor unit connected in series between the first and second input terminals.

Each of the upper and lower variable resistor units may include a plurality of variable resistors connected in series to one another.

Each of the plurality of variable resistors may have a resistance configured to change depending upon an external control signal.

The voltage distribution unit may include a plurality of fixed resistors connected in series to one another and a variable resistor connected in series between (some of) the fixed resistors.

Each of the plurality of variable resistors may have a resistance configured to change depending upon an external control signal.

According to another aspect of the present invention, there is provided a display device, including: a display panel for displaying an image thereon; and a driving circuit for driving the display panel. The driving circuit includes a driving voltage generator for outputting a plurality of reference voltages; and a gray scale voltage generating unit for selecting one out of the plurality of reference voltages as a gamma reference voltage and generating a gray scale voltage based on the selected gamma reference voltage.

The gray scale voltage generating unit may include a voltage selector for selecting and outputting one out of the plurality of reference voltages as the gamma reference voltage; a voltage distributor for generating a plurality of distribution voltages using the selected gamma reference voltage; a multiplexer unit for selecting some of the plurality of distribution voltages and outputting them as gray scale selection voltages; and a gray scale voltage output unit for generating a plurality of gray scale voltages using the gray scale selection voltages and outputting the plurality of gray scale voltages.

The voltage selector may include at least one multiplexer.

The multiplexer may change the gamma reference voltage to be output in accordance with an external control signal.

The display panel may include a liquid crystal display panel.

The driving circuit may further include a driving voltage generator for generating the plurality of reference voltages having different voltage levels.

The driving voltage generator may include a plurality of DC-to-DC converters.

According to a further aspect of the present invention, there is provided a method for driving a display device, including: generating a plurality of reference voltages; selecting one among the plurality of reference voltages as a gamma reference voltage; generating a gray scale voltage using the selected gamma reference voltage applying the gray scale voltage to a pixel of the display panel; and changing the gray scale voltage (e.g., to be suitable for an image signal) and applying the changed gray scale voltage to the pixel.

Generating a plurality of reference voltages may include generating the plurality of reference voltages having different potentials.

Selecting one among the plurality of reference voltages may include selecting one among the plurality of reference voltages depending on a user's action.

However, the present invention is not limited to the embodiments disclosed below but may be implemented into different forms. These embodiments are provided only for illustrative purposes and for full understanding of the scope of the present invention by those skilled in the art. Throughout the drawings, like reference numerals are used to designate like elements.

BRIEF DESCRIPTION OF THE DRAWINGS

Exemplary embodiments of the present invention can be described in more detail and understood from the following description taken in conjunction with the accompanying drawings, in which:

FIG. 4 is a table illustrating an exemplary configuration of gamma selection signals for use in the display of FIG. 1.

DETAILED DESCRIPTION OF THE PREFERRED EMBODIMENTS

Figure 1:
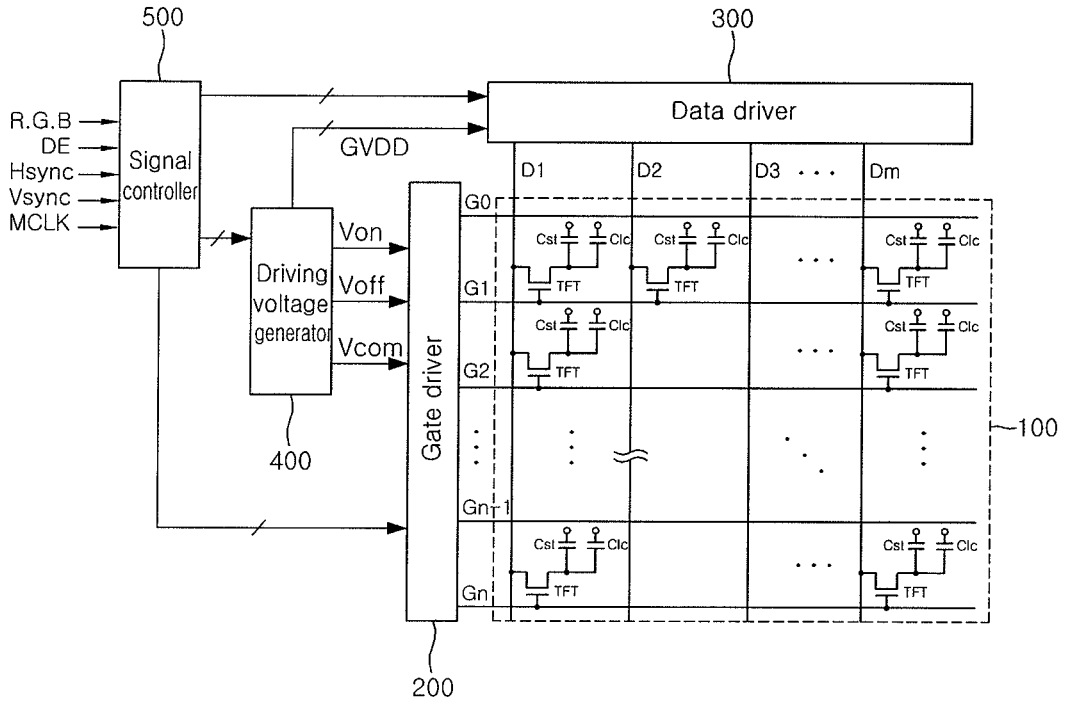
FIG. 1 is a block diagram of a liquid crystal display according to an exemplary embodiment of the present invention.
Figure 2:
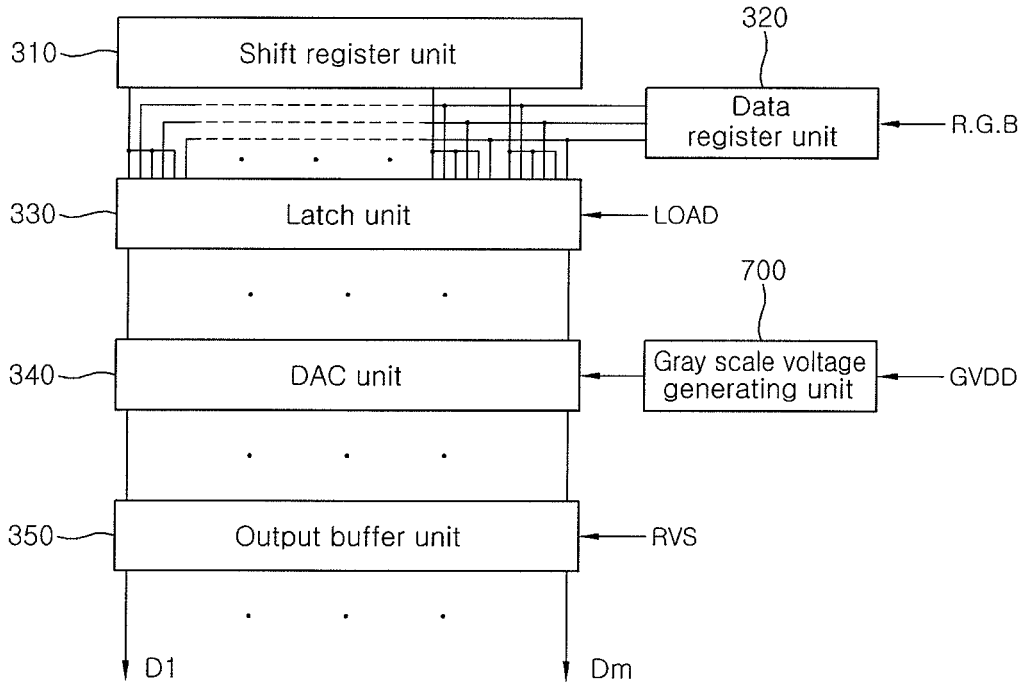
FIG. 2 is a block diagram of an exemplary implementation of the data driver in the liquid crystal display of FIG. 1.

FIG. 1 is a block diagram of liquid crystal display (LCD) according to an exemplary embodiment of the present invention, and FIG. 2 is a block diagram of the data driver 300 shown in FIG. 1

Referring to FIG. 1, the LCD according to this exemplary embodiment includes an LCD panel 100 for displaying images, and liquid crystal driving circuits 200, 300, 400 and 500 for controlling the LCD panel 100.

The LCD panel 100 includes a plurality (n) of gate lines G1 to Gn extending in a first direction, a plurality of data lines D1 to Dm extending in a second direction that intersect the plurality of gate lines G1 to Gn, and a plurality of unit pixels provided at respective intersection regions of the gate lines and data lines. Each of the plurality of unit pixels is formed with a thin film transistor TFT, a liquid crystal capacitor Clc, a storage capacitor Cst.

The gate, source and drain terminals of the thin film transistors TFT are connected to the gate lines (G1 to Gn), the data lines (D1 to Dm) and pixel electrodes (not shown) of the liquid crystal capacitors C1*c*, respectively. Such thin film transistors TFT are activated (turned ON) by gate turn-on voltages (Von) applied to their gates via the gate lines G1 to Gn. When activated, the TFTs supply data signals applied to the data lines D1 to Dm to the liquid crystal capacitors C1*c* and the storage capacitors Cst. Each of the liquid crystal capacitors Clc is configured so that a liquid crystal layer, being a dielectric material, is provided between the pixel electrode and a common electrode opposite thereto. The liquid crystal capacitor Clc serves to control the arrangement of liquid crystal molecules in the liquid crystal layer by allowing a voltage representing a data signal to be charged therein when the thin film transistor TFT is turned ON. The storage capacitor Cst is configured so that a protection layer, also a dielectric material, is provided between the pixel electrode and a storage electrode opposite thereto. The storage capacitor Cst serves to stably sustain the voltage representing the data signal charged in the liquid crystal capacitor Clc until the next data signal is charged therein. The storage capacitor Cst performing an auxiliary function of the liquid crystal capacitor Clc may be omitted. Each unit pixel in this embodiment represents one of three primary colors (red, green and blue). Color filters are provided in the respective unit pixels, and a black matrix for preventing light leakage is provided between adjacent unit pixel regions.

The liquid crystal driving circuit, which includes a signal controller 500, a driving voltage generator 400, a gate driver 200 and a data driver 300, is provided outside the LCD panel 100. The liquid crystal driving circuit provides various kinds of control signals for the operation of the LCD panel 100.

The gate and data drivers 200 and 300 may be directly formed on the lower substrate of the LCD panel (an ASG method), or may be separately manufactured and mounted upon the lower substrate by a method such as COB (Chip On Board), TAB (Tape Automated Bonding) or COG (Chip On Glass). The gate and data drivers 200 and 300 of this embodiment may be manufactured in the form of at least one chip and mounted on the lower substrate. Further, the signal controller 500 and the driving voltage generator 400 may be mounted on a printed circuit board (PCB) and connected to the gate and data drivers 200 and 300 through a flexible printed circuit board (FPCB) to be electrically connected to the LCD panel 100.

The signal controller 500 receives an input image (data) signal and an input control signal, which are provided from an external graphic controller (not shown). For example, an input image (data) signal including image data R, G and B, and an input control signal including a vertical synchronization signal Vsync, a horizontal synchronization signal Hsync, a main clock MCLK and a data enable signal DE may be received by the signal controller 500.

Further, the signal controller 500 generates internal image data R, G and B by processing an input image signal to be suitable for the operating conditions of the LCD panel 100, and generates gate and data control signals. Then, the signal controller 500 transmits the gate control signal to the gate driver 200, and transmits the image data R, G and B and the data control signal to the data driver 300. The image data R, G and B may be resequenced in accordance with the physical arrangement of colors of the pixels of the LCD panel 100, and may be corrected through an image correction circuit. Further, the gate control signal includes a vertical synchronization start signal STV indicating an output start of a gate turn-on voltage Von, a gate clock signal CPV, an output enable signal OE and the like. The data control signal includes a horizontal synchronization start signal STH indicating a start of a transmission of image data, a load signal LOAD allowing a data signal to be applied to a corresponding data line, a reverse signal RVS allowing the polarity of a gray scale voltage to be reversed with respect to the common voltage, a data clock signal DCLK and the like.

The driving voltage generator 400 generates and outputs various driving voltages required in driving the LCD panel 100 using external power input from an external power source (not shown). For example, the driving voltage generator 400 generates the gate turn-on voltage Von for turning on a thin film transistor TFT, a gate-off voltage Voff for turning off the switching element TFT, and the like to output them to the gate driver 200. The driving voltage generator 400 also generates gamma reference voltages GVDD to output them to the data driver 300, and generates a common voltage Vcom to apply it to the liquid crystal capacitor Clc and the storage capacitor Cst via the common electrode. The driving voltage generator 400 of this exemplary embodiment is provided with a plurality of DC-to-DC converters, and thus, generates and outputs a plurality of gamma reference voltages GVDD at different voltage levels. A selected one of the gamma reference voltages GVDD is used as a reference voltage for the generation of a gray scale voltage for driving the liquid crystal pixels.

The gate driver 200 starts to operate upon activation by the vertical synchronization signal STV, and then, is synchronized with a gate clock signal CPV to sequentially output a gate signal, including the gate-on and gate-off voltages Von and Voff input from the driving voltage generator 400, to the plurality of gate lines G1 to Gm that are formed in the LCD panel. Preferably the gate-on voltage Von is output in the high phase of the gate clock signal CPV, and a gate-off voltage Voff is output in the low phase of the gate clock signal CPV.

The data driver 300 generates a gray scale voltage using the selected gamma reference voltage GVDD from the driving voltage generator 400. By using the gray scale voltage, the data driver 300 converts the digital input image data into analog data signals and applied the analog data signals to the respective data lines D1 to Dm.

As shown in FIG. 2, the data driver 300 includes a shift register unit 310 for sequentially transmitting sampling signals, a data register unit 320 for temporarily storing internal image data R, G and B, a latch unit 330 for sampling and latching the internal image data R, G and B through sampling signals, a gray scale voltage generating unit 700 for generating a plurality of gray scale voltages, a digital-to-analog converter (DAC) unit 340 for converting the latched internal image data R, G and B into a gray scale voltage, and an output buffer unit 350 for applying the gray scale voltage to the data lines D1 to Dm.

The shift register unit 310 generates sampling signals on based on the control signal received from the signal controller 500 (see FIG. 1) to supply the generated sampling signals to the latch unit 330. Thus, the shift register unit 310 begins operation for each row of the pixels in response to the horizontal synchronization start signal STH indicating an input start of the image data R, G and B for one row of the pixels. The shift register unit 310 is synchronized with a data clock signal DCLK to output the generated sampling signals. The data register unit 320 temporarily stores the image data R, G and B sequentially received from the signal controller 500. The latch unit 330 samples and latches the image data R, G and B temporarily stored in the data register unit 320, in sync with the sampling signals of the shift register unit 310. The latch unit 330 simultaneously latches (and outputs) the image data R, G and B for one row of the pixels, i.e., the image data R, G and B corresponding to the activated pixels connected to the currently active one of the gate lines G1 to Gm, in response to a load signal LOAD. The gray scale voltage generating unit 700 distributes a gamma reference voltage GVDD into gray scale voltages having a plurality of levels through a voltage distributor to apply the distributed gray scale voltages to the DAC unit 340. The number of levels of gray scale voltages varies depending on the number of bits of image data for each color R, G and B. For example, in a case where the image data R, G and B are 8 bits, the gray scale voltage has 256 levels. The DAC unit 340 converts a gray scale voltage selected corresponding to the digital image data R, G and B into an analog data signal. The output buffer unit 350 amplifies the current of the analog data signals output from the DAC unit 340 and then applies the amplified data signals to the respective data lines D1 to Dm. The output buffer unit 350 includes a plurality of output buffers connected to the respective data lines D1 to Dm. Preferably, a differential amplifier is used as each output buffer in the output buffer unit 350 in this embodiment.

The gray scale voltage generating unit 700 generates different combinations (sets) of gray scale voltages by changing the gamma reference voltage GVDD (e.g., depending on the selection of a user or system), so that the gamma characteristic and viewing angle of an output image can be dynamically controlled to be suitable for a user's preference and environment through such gray scale voltages. Hereinafter, the gray scale voltage generating unit 700 will be described in detail.

Figure 3:
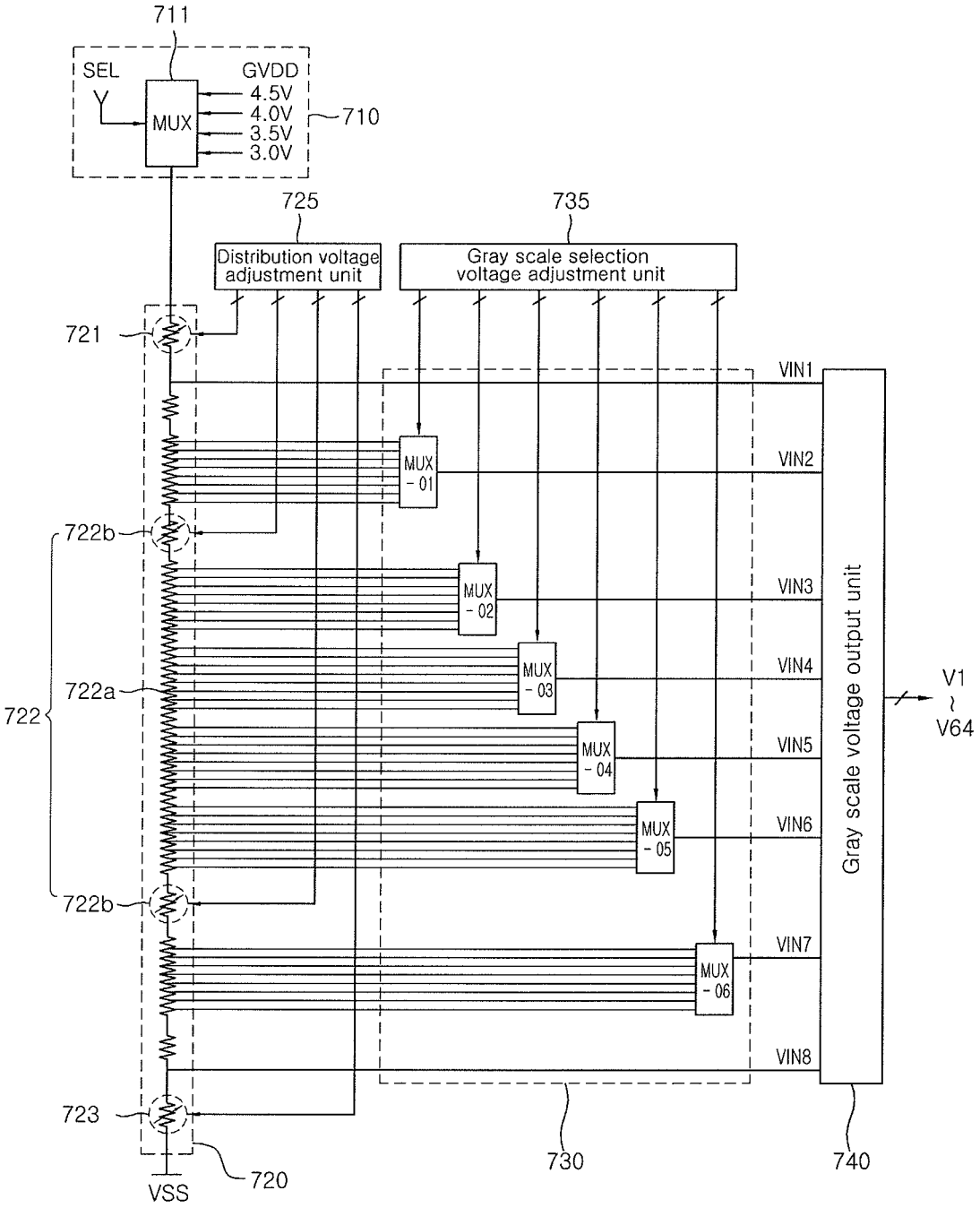
FIG. 3 is a block diagram of an exemplary implementation of the gray scale voltage generating unit in the liquid crystal display of FIG. 1.

FIG. 3 is a block diagram of an exemplary implementation of the gray scale voltage generating unit 700 shown in FIG. 2 according to an exemplary embodiment of the present invention, and FIG. 4 is a table illustrating an exemplary relation between gamma selection signals and the resulting Gamma reference voltages (GVDD) according to an exemplary embodiment of the present invention.

Referring to FIG. 3, the gray scale voltage generating unit 700 according to an exemplary embodiment includes a voltage selector 710 for selecting and outputting one out of the plurality of gamma reference voltages GVDD, a voltage distributor 720 for generating a plurality of distribution voltages using the selected gamma reference voltage GVDD, a multiplexer unit 730 for dynamically selecting some (a subset) of distribution voltages among the plurality of distribution voltages. The dynamically selected set of distribution voltages is outputted as gray scale selection voltages VIN1 to VIN8. The gray scale voltage generating unit 700 according to an exemplary embodiment further includes a gray scale voltage output unit 740 for generating and outputting a plurality of gray scale voltages V1 to V64 based upon the gray scale selection voltages VIN1 to VIN8.

The voltage selector 710 includes at least one multiplexer 711 for selecting and outputting one of the plurality of gamma reference voltages GVDD provided from the driving voltage generator 400 (FIG. 1). The multiplexer 711 receives a gamma selection signal SEL generated based on the command (selection) of a user or system, and then selects and outputs the selected one out of the gamma reference voltages selected in accordance with the gamma selection signal SEL. The gamma selection signal SEL can be defined as shown in the table illustrated in FIG. 4. Referring to FIG. 4, the gamma selection signal SEL includes a plurality of electrical signals distinguished from one another such that one out of the plurality of gamma reference voltages GVDD input to the multiplexer 711 can be selected. For example, since four types of gamma reference voltages GVDD, e.g., 4.5V, 4.0V, 3.5V and 3.0V, are output from the driving voltage generator 400 in this exemplary embodiment, four types of gamma selection signals SEL are encoded in two binary bits such that one of the four gamma reference voltages GVDD can be selected by varying the two bits of the gamma selection signal SEL. Thus, a first gamma selection signal 00 (low-low) selects a gamma reference voltage of 4.5V, and a second gamma selection signal 01 (low-high) selects a gamma reference voltage of 4.0V. Further, a third gamma selection signal 10 (high-low) selects a gamma reference voltage of 3.5V, and a fourth gamma selection signal 11 (high-high) selects a gamma reference voltage of 3.0V. Of course, the voltage selector 710 of this embodiment is not limited to a software controllable means such as a digitally controlled multiplexer for performing switching operation in accordance with a user's selection signal SEL. Thus, a hardware means such as a DIP or toggle switch, dial or lever may be used as the voltage selector 710.

Referring again to FIG. 3, the voltage distributor 720 includes an upper variable resistor unit 721, a voltage distribution unit 722 and a lower variable resistor unit 723, which are connected in series between a first input terminal, to which a highest potential voltage, i.e., the gamma reference voltage GVDD is applied, and a second input terminal, to which a lowest potential voltage, i.e., a ground voltage VSS is applied. Here, each of the upper and lower variable resistor units 721 and 723 has at least one variable resistor. The voltage distribution unit 722 has a plurality of fixed resistors 722*a* connected in series to one another and at least one variable resistor 722*b* connected in series between some fixed resistors. The gamma reference voltage GVDD applied to the first input terminal of the voltage distributor 720 is distributed into a plurality of distribution voltages by means of the voltage distribution unit 722 in a state where the maximum and minimum values of the plurality of distribution voltages are respectively adjusted by the upper and lower variable resistor units 721 and 723. Preferably, a digital variable resistor of which the resistance is varied depending on an external control signal is used as each of the variable resistors 721, 722*b* and 723 provided in the voltage distributor 720 of this embodiment. Thus, it is preferred that the gray scale voltage generating unit 700 further include a distribution voltage adjustment unit 725 for controlling the adjustment of the maximum and minimum values of the distribution voltages by changing the resistances of the upper and lower variable resistor units 721 and 723 through first and second control signals, respectively, and adjusting a distribution interval between the distribution voltages (a difference between voltages) by changing the resistance of the variable resistor 722*b* of the voltage distribution unit 722 through a third control signal. Through the distribution voltage adjustment unit 725, the maximum and minimum values of the distribution voltages generated from the voltage distributor 720 can be more finely set up, and the distribution interval between the distribution voltages can be more finely adjusted.

Only one gamma reference voltage GVDD is provided to a conventional voltage distributor, while a selected one of four different gamma reference voltages GVDD is selectively provided to the voltage distributor 720 of this exemplary embodiment. Thus, even without the variable resistors 721, 722*b* and 723, given the same gamma reference voltage GVDD, the voltage distributor 720 of this embodiment can generate more distribution voltages than the conventional voltage distributor does.

The multiplexer unit 730 includes a plurality of multiplexers, for example six multiplexers MUX-01 to MUX-06. Preferably, each of the plurality of multiplexers MUX-01 to MUX-06 is a 8-to-1 multiplexer controlled by a separate selection signal from a gray scale selection voltage adjustment unit 735. Each of the multiplexers MUX-01 to MUX-06 selects one out of 8 input distribution voltages and outputs the selected distribution voltage as one of six gray scale selection voltages VIN2 to VIN7. The uppermost and lowermost distribution voltages VIN1 and VIN8 do not pass through the multiplexers MUX-01 to MUX-06 to be output as uppermost and lowermost gray scale selection voltages. In alternative embodiments the multiplexer unit 730 may include eight multiplexers MUX-00 (not shown) to MUX-07 (not shown) each generating one of the eight gray scale selection voltages VIN1 to VIN8. In the present exemplary embodiment, the variable resistors 721 and 723 serve as substitutes for the first and last multiplexer MUX-00 (not shown) to MUX-07 (not shown) and for a fixed voltage divider (e.g., a plurality of fixed resistance resistors).

Each of the six multiplexers MUX-01 to MUX-06 receives a selection signal from the gray scale selection voltage adjustment unit 735 and determines a gray scale selection voltage to be output in accordance with the selection signal.

The gray scale output unit 740 generates and outputs a plurality (e.g., 64) of gray scale voltages V1 to V64 using the plurality (eight) of gray scale selection voltages VIN1 to VIN8 (e.g., output from the multiplexer unit 730). For example, the gray scale voltage output unit 740 according to the present embodiment, in which 64 gray levels are required because image data have 8 bits, outputs the first gray scale selection voltage VIN1 as the first gray scale voltage V1, the second gray scale selection voltage VIN2 as a second gray scale voltage V2, the third gray scale selection voltage VIN3 as the ninth gray scale voltage V9, the fourth gray scale selection voltage VIN4 as the twenty-first gray scale voltage V21, the fifth gray scale selection voltage VIN5 as the forty-fourth gray scale voltage V44, a sixth gray scale selection voltage VIN6 as a fifty-sixth gray scale voltage V56, the seventh gray scale selection voltage VIN7 as the sixty-third gray scale voltage V63, and the eighth gray scale selection voltage VIN8 as the sixty-fourth gray scale voltage V64. Further, the gray scale voltage output unit 740 generates third to eighth gray scale voltages V3 to V8 using (by dividing) the second and third gray scale selection voltages VIN2 and VIN3, the tenth to twentieth gray scale voltages V10 to V20 using the third and fourth gray scale selection voltages VIN3 and VIN4, the twenty-second to forty-third gray scale voltages V22 to V43 using the fourth and fifth gray scale selection voltages VIN4 and VIN5, the forty-fifth to fifty-fifth gray scale voltages V45 to V55 using the fifth and sixth gray scale selection voltages VIN5 and VIN6, and the fifty-seventh to sixty-second gray scale voltages V57 to V62 using the sixth and seventh gray scale voltages VIN6 and VIN7.

The gray scale voltage generating unit 700 may generate and output positive and negative gray scale voltages. The gray scale voltage generating unit 700 may have positive and negative voltage distributors although not shown. Further, there may be provided a positive multiplexer unit for generating positive gray scale selection voltages VIN1+ to VIN8+ using distribution voltages of the positive voltage distributor and a negative multiplexer unit for generating negative gray scale selection voltages VIN1− to VIN8− using distribution voltages of the negative voltage distributor. The gray scale voltage output unit 740 may generate positive gray scale voltages V1+ to V64+ using the positive gray scale selection voltages VIN1+ to VIN8+, and generate negative gray scale voltages V1− to V64− using the negative gray scale selection voltages VIN1− to VIN8−. Accordingly, the positive and negative gray scale voltages V1+ to V64+ and V1− to V64− are generated in such a manner, whereby gray scale voltages with different polarities can be provided to the LCD panel 100.

As described above, the gray scale voltage generating unit 700 according to this embodiment selects one out of the plurality of gamma reference voltages GVDD through the voltage selector 710 and generates a plurality of distribution voltages by distributing (dividing) the selected gamma reference voltage through the voltage distributor 720. Further, the gray scale voltage generating unit 700 generates gray scale selection voltages VIN1 to VIN8 using some of the plurality of distribution voltages and then generates gray scale voltages V1 to V64 with a plurality of voltage levels by selecting and/or dividing the gray scale selection voltages VIN1 to VIN8. Accordingly, the LCD having the aforementioned gray scale voltage generating unit 700 can generate the plurality of gray scale voltages V1 to V64 whose precise voltages depend on a selection of a user or system, and change the gamma characteristic of an output image in accordance with the plurality of gray scale voltages V1 to V64, so that the gamma characteristic and viewing angle of an output image can be actively controlled to be suitable for a user's preference and environment.

Although it is described in the aforementioned description that the gray scale voltage generating unit 700 is provided within the data driver 300, the present invention is not limited thereto. Thus, the gray scale voltage generating unit 700 may be provided external to the data driver 300 as an additional module.

Hereinafter, a process of controlling the gamma characteristic and viewing angle of an output image through the change of gray scale voltages V1 to V64 will be described with reference to FIGS. 1 through 4.

The driving voltage generator 700 generates the plurality of gamma reference voltages GVDD and provides them to the data driver 300. For example, in this embodiment, there are provided four gamma reference voltages GVDD, i.e., 4.5V, 4.0V, 3.5V and 3.0V.

Referring to FIG. 1, the gate driver 200 applies the gate-on voltage Von to the first gate line G1 to turn on the switching elements TFT connected to the corresponding gate line G1, thereby selecting the first scan line to which a data signal will be applied.

The data driver 300 sequentially receives the digital image data R, G and B, selects the analog gray scale voltage corresponding to a gray level of each of the image data R, G and B out of the gray scale voltages V1 to V64, and then applies the corresponding gray scale voltage to the scan line as an analog data signal. The gray scale voltage generating unit 700 in the data driver 300 can change the combinations of the gray scale voltages V1 to V64 depending on the external selection signal as described above. For example, a user may press a keyboard or up/down key to allow the gamma selection signal SEL to be changed, and the gamma reference voltage GVDD is thus changed depending on the gamma selection signal generated through the user's key operation, so that the gray scale voltages V1 to V64 generated on the basis of the changed gamma reference voltage GVDD can be changed to have a combination different from the previous gray scale voltages.

When data and gate signals are respectively applied to specific ones of the data lines D1 to Dm and gate lines G1 to en, the switching element TFT of the selected pixel (a specific pixel corresponding to the intersection region of the data and gate lines) is turned ON, so that a predetermined electric field is formed across the liquid crystal in the unit pixel. Therefore, the arrangement of molecules in the liquid crystal layer is changed, and thus the transmissivity of light incident through the liquid crystal layer is changed. Thereafter, the light passing through the liquid crystal layer is colored by red R, green G and blue B color filters, and then emitted. The light emitted from the respective pixels is mixed to implement a color image.

The gray scale voltages V1 to V64 applied to the unit pixels are important factors in determining the gamma characteristic and viewing angle of an output image. The gray scale voltages V1 to V64 vary depending on the selected gamma reference voltage GVDD. Thus, if the gamma reference voltage GVDD is changed, the gray scale voltages V1 to V64 are changed. Then, if the gray scale voltages V1 to V64 are changed, the electric field in the unit pixels for controlling the arrangement of liquid crystal molecules is changed. Therefore, the light transmissivity of the liquid crystal layer is changed, and thus the gamma characteristic and viewing angle of an output image is changed.

Figure 5:
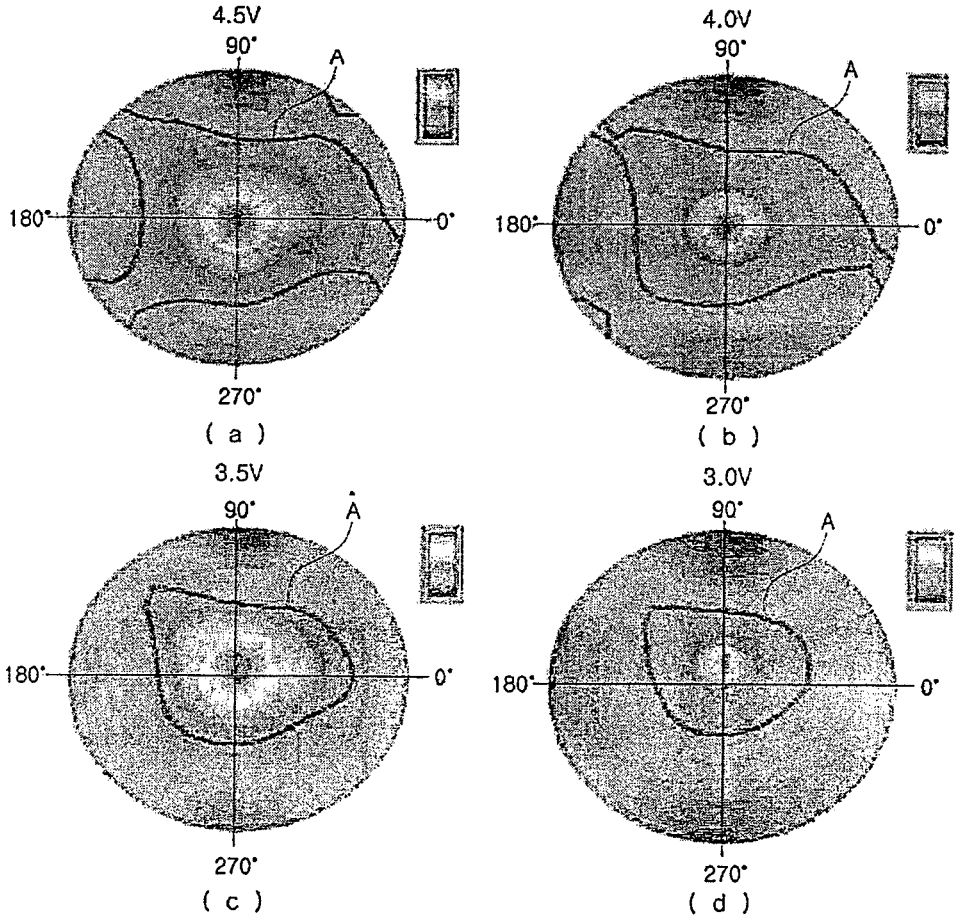
FIG. 5 is a series of photographs of a display according to an embodiment of the present invention illustrating a viewing angle characteristic for each gamma reference voltage in the table of FIG. 4.

FIG. 5 is a series of photographs of the same LCD panel illustrating a viewing angle characteristic for each gamma reference voltage in the table of FIG. 4, according to the exemplary embodiment of the present invention. The viewing angle characteristic is illustrated by measuring contrast of an output image as only a gamma reference voltage is changed under the same conditions. The intersection point of abscissa and ordinate axes represents the center of the LCD display screen.

Referring to FIG. 5, if the gamma reference voltage of 4.5V is selected, the output image has a viewing angle characteristic as shown in FIG. 5(*a*). If the gamma reference voltage of 4.0V is selected, the output image has a viewing angle characteristic as shown in FIG. 5(*b*). Further, if the gamma reference voltage of 3.5V is selected, the output image has a viewing angle characteristic as shown in FIG. 5(*c*). If the gamma reference voltage of 3.0V is selected, the output image has a viewing angle characteristic as shown in FIG. 5(*d*). Here, effective ranges of viewing angles will be discussed with reference to lines A in the respective figures. It can be seen that the effective range of a viewing angle is formed to be widest when the gamma reference voltage is 4.5V, and the effective range of a viewing angle is formed to be narrowest when the gamma reference voltage is 3.0V. This means that the viewing angle is widest when the gamma reference voltage is greatest (e.g., 4.5V) and the viewing angle is narrowest when the gamma reference voltage is the lowest (e.g., 3.0V). Thus, in a case where a user desires a wide viewing angle, it is preferred that the gamma reference voltage GVDD with a relatively high potential be selected as shown in FIG. 5(*a*). On the other hand, in a case where a user desires a narrow viewing angle, it is preferred that the gamma reference voltage GVDD have a relatively low potential as shown in FIG. 5(*d*).

In the LCD according to this embodiment, the gamma reference voltage is selectively changed depending on a user's selection, so that gray scale voltages are changed, thereby varying the gamma characteristic and viewing angle of an output image. Accordingly, a user can actively control the gamma characteristic and viewing angle of an output image to be suitable for the user's preference and environment.

Although an LCD is illustrated in this embodiment, the present invention is not limited thereto. Thus, a driving circuit according to the present invention may be applied to various display devices in which unit pixels are configured in a matrix form and the active matrix driving can be performed. For example, a driving circuit according to the present invention can be applied to various display devices such as a plasma display panel (PDP) and an organic electronic luminescence (OEL) display.

As described above, according to principles of the present invention, a gamma reference voltage is selectively changed depending on a user's selection, so that the gray scale voltages are changed, thereby varying the gamma characteristic and viewing angle of the output image. Accordingly, a user can actively control the gamma characteristic and viewing angle of an output image to be suitable for the user's preference and environment.

Although the present invention has been described in connection with the accompanying drawings and the preferred embodiment, the present invention is not limited thereto but defined by the appended claims. Accordingly, it will be understood by those skilled in the art that various modifications and changes can be made thereto without departing from the spirit and scope of the invention defined by the appended claims.

What is claimed is:

1. A driving circuit for a display panel, comprising:

a driving voltage generator configured to output a gate-on voltage, a gate-off voltage, a common electrode voltage, and a plurality of reference voltages; and a gray scale voltage generating unit configured to dynamically select based upon user viewing angle from one among the plurality of reference voltages generated by the driving voltage generator as a selected gamma reference voltage and to generate a plurality of gray scale voltages based on the selected gamma reference voltage, wherein a highest reference voltage corresponds to a widest viewing angle and a lowest reference voltage corresponds to a narrowest user viewing angle, wherein the gray scale voltage generating unit comprises:

a voltage selector for selecting and outputting one from among the plurality of reference voltages provided by the driving voltage generator as the selected gamma reference voltage;

a voltage distributor for generating a plurality of distribution voltages using the selected gamma reference voltage;

a multiplexer unit for selecting some of the plurality of distribution voltages and outputting the selected distribution voltages as gray scale selection voltage; and a gray scale voltage output unit for generating a plurality of gray scale voltages using the gray scale selection voltages and outputting the plurality of gray scale voltages, and wherein the common electrode voltage is independent of the plurality of reference voltages.

2. The driving circuit as claimed in claim 1, wherein the voltage selector comprises at least one multiplexer.

3. The driving circuit as claimed in claim 2, wherein the multiplexer selects and outputs one out of the plurality of gamma reference voltages based upon an external control signal.

4. The driving circuit as claimed in claim 1, wherein the driving circuit further comprises a driving voltage generator for generating the plurality of reference voltages having different voltage levels.

5. The driving circuit as claimed in claim 4, wherein the driving voltage generator comprises a plurality of DC-to-DC converters.

6. The driving circuit as claimed in claim 1, wherein the voltage distributor comprises:

a first input terminal to which a high potential voltage is applied;

a second input terminal to which a low potential voltage is applied; and a voltage distribution unit connected in series between the first and second input terminals.

7. The driving circuit as claimed in claim 6, wherein the voltage distributor further comprises:

an upper variable resistor unit and a lower variable resistor unit connected in series between the first and second input terminals, wherein the voltage distribution unit is connected in series between the upper variable resistor unit and the lower variable resistor unit.

8. The driving circuit as claimed in claim 7, wherein each of the upper and lower variable resistor units comprises a variable resistor.

9. The driving circuit as claimed in claim 8, wherein each of the plurality of variable resistors has a resistance configured to change depending on an external control signal.

10. The driving circuit as claimed in claim 6, wherein the voltage distribution unit comprises a plurality of fixed resistors connected in series to one another and forming a voltage divider.

11. The driving circuit as claimed in claim 10, wherein the voltage distribution unit further comprises a variable resistor connected in series with the fixed resistors.

12. The driving circuit as claimed in claim 11, wherein the variable resistor has a resistance configured to change depending upon an external control signal.

13. A display device, comprising:

a display panel for displaying an image thereon; and a driving circuit for driving the display panel, wherein the driving circuit comprises:

a driving voltage generator configured to output a gate-on voltage, a gate-off voltage, a common electrode voltage, and a plurality of reference voltages; and a gray scale voltage generating unit configured to dynamically select based upon user viewing angle from one among the plurality of reference voltages generated by the driving voltage generator as a selected gamma reference voltage and to generate a plurality of gray scale voltages based on the selected gamma reference voltage, wherein a highest reference voltage corresponds to a widest viewing angle and a lowest reference voltage corresponds to a narrowest user viewing angle, wherein the gray scale voltage generating unit comprises:

a voltage selector configured to dynamically select and output one from among the plurality of gamma reference voltages provided by the driving voltage generator as the selected gamma reference voltage;

a voltage distributor configured to generate a plurality of distribution voltages using the selected gamma reference voltage;

a multiplexer unit for selecting some of the plurality of distribution voltages and outputting the selected distribution voltages as gray scale selection voltages; and a gray scale voltage output unit for generating a plurality of gray scale voltages based upon and different from the gray scale selection voltages and outputting the plurality of gray scale voltages, and wherein the common electrode voltage is independent of the plurality of reference voltages.

14. The display device as claimed in claim 13, wherein the voltage selector comprises at least one multiplexer.

15. The display device as claimed in claim 14, wherein the multiplexer selects the gamma reference voltage to be output based upon an external control signal.

16. The display device as claimed in claim 13, wherein the display panel comprises a liquid crystal display panel.

17. The display device as claimed in claim 13, wherein the driving circuit further comprises a driving voltage generator configured to generate the plurality of reference voltages having different voltage levels.

18. The display device as claimed in claim 17, wherein the driving voltage generator comprises a plurality of DC-to-DC converters.

19. A method for driving a display device, comprising:

generating a gate-on voltage, a gate-off voltage, a common electrode voltage, and a plurality of reference voltages;

selecting based upon user viewing angle one out of the plurality of reference voltages as a selected gamma reference voltage; and generating a gray scale voltage using the selected gamma reference voltage and applying the gray scale voltage to a pixel of the display panel, wherein a highest reference voltage corresponds to a widest viewing angle and a lowest reference voltage corresponds to a narrowest user viewing angle, wherein:

a driving voltage generator outputs the gate-on voltage, the gate-off voltage, the common electrode voltage, and the plurality of reference voltages;

a voltage selector selects and outputs one from among the plurality of reference voltages provided by the driving voltage generator as the selected gamma reference voltage;

a voltage distributor generates a plurality of distribution voltages using the selected gamma reference voltage;

a multiplexer unit selects some of the plurality of distribution voltages and outputs the selected distribution voltages as gray scale selection voltage; and a gray scale voltage output unit generates a plurality of gray scale voltages, and wherein the common electrode voltage is independent of the plurality of reference voltages.

20. The method as claimed in claim 19, further comprising:

selecting a different one out of the plurality of reference voltages as the selected gamma reference voltage and generating a changed gray scale voltage using the different gamma reference voltage, and applying the changed gray scale voltage to the pixel of the display panel.

21. The method as claimed in claim 19, wherein generating a plurality of reference voltages comprises generating the plurality of reference voltages having different potentials from the same supply voltage.

22. The method as claimed in claim 19, wherein step selecting one out of the plurality of reference voltages as a selected gamma reference voltage comprises selecting one out of the plurality of reference voltages depending on a gamma selection signal based upon a user's action.

* * * * *